US008228206B2

(12) United States Patent
Manahan

(10) Patent No.: US 8,228,206 B2
(45) Date of Patent: Jul. 24, 2012

(54) EXPLOSION INDICATOR FOR EXPLOSION-PROOF ENCLOSURES

(75) Inventor: Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 523 days.

(21) Appl. No.: 12/193,094

(22) Filed: Aug. 18, 2008

(65) Prior Publication Data

US 2010/0039256 A1 Feb. 18, 2010

(51) Int. Cl.
*G08B 21/00* (2006.01)
*F21L 4/00* (2006.01)

(52) U.S. Cl. ..... 340/626; 340/686.1; 340/540; 340/665; 362/158

(58) Field of Classification Search ..... None
See application file for complete search history.

(56) References Cited

U.S. PATENT DOCUMENTS

| | | | | |
|---|---|---|---|---|
| 1,692,012 | A | 11/1928 | Wells | 116/216 |
| 2,764,979 | A | 10/1956 | Henderson | |
| 2,805,523 | A | 9/1957 | Springer | |
| 3,233,459 | A | 2/1966 | Gleason et al. | 374/106 |
| 3,452,706 | A | 7/1969 | Vogt | |
| 3,515,091 | A | 6/1970 | Smith | 116/203 |
| 3,548,780 | A | 12/1970 | Kliewer | |
| 3,559,615 | A | 2/1971 | Kliewer | |
| 3,765,025 | A | 10/1973 | Zietzke et al. | 346/7 |
| 3,965,741 | A | 6/1976 | Wachtell et al. | 374/102 |
| 4,082,000 | A | 4/1978 | Volk | |
| 4,143,617 | A | 3/1979 | Youngren | 374/102 |
| 4,156,891 | A | 5/1979 | Roche | 362/20 |
| 4,183,536 | A | 1/1980 | Platt | 473/570 |
| 4,356,790 | A | 11/1982 | Gee | |
| 4,362,121 | A * | 12/1982 | Pegram | 116/34 R |
| 4,421,053 | A | 12/1983 | Volk | |
| 4,445,456 | A | 5/1984 | Nelson | |
| 4,512,278 | A | 4/1985 | Winther | |
| 4,748,931 | A | 6/1988 | Volk | |
| 4,789,922 | A * | 12/1988 | Cheshire | 362/158 |
| 5,027,740 | A | 7/1991 | Kramer et al. | 116/34 R |
| 5,144,112 | A | 9/1992 | Wyatt et al. | 219/386 |
| 5,144,880 | A | 9/1992 | Schmit | |
| 5,537,950 | A | 7/1996 | Ou-Yang | |
| 5,616,157 | A | 4/1997 | Mead et al. | |
| 5,821,695 | A | 10/1998 | Vilanilam et al. | 315/58 |
| 5,918,262 | A | 6/1999 | Sanford | 73/35.14 |
| 5,988,102 | A | 11/1999 | Volk et al. | |
| 6,531,960 | B1 | 3/2003 | Gladstone et al. | 340/442 |
| 6,609,865 | B2 | 8/2003 | Daigneault | 411/13 |
| 6,639,190 | B2 | 10/2003 | Lerner | 219/445.1 |
| 6,651,834 | B2 | 11/2003 | Wong | |
| 6,700,100 | B2 | 3/2004 | Lerner | 219/445.1 |
| 6,848,389 | B1 | 2/2005 | Elsasser et al. | 116/203 |

(Continued)

*Primary Examiner* — Julie Lieu
(74) *Attorney, Agent, or Firm* — King & Spalding LLP

(57) ABSTRACT

Indicator devices and systems for explosion-proof enclosures are described. The indicator devices include a sleeve coupled to a dome-like transparent member by a connector body, at least one conductive contact positioned in the sleeve, a piston responsive to an increase in pressure and positioned in the sleeve, and an indicator. The indicator can be a light source positioned in the transparent member or an alarm external to the indicator device. Upon an increase in a pressure in an enclosure to which an indicator device is attached, the piston shifts and contacts the at least one conductive contact and permits the completion of an electrical circuit from a power source to the indicator. The indicator systems include an indicator device coupled to an explosion-proof enclosure.

24 Claims, 5 Drawing Sheets

U.S. PATENT DOCUMENTS

| | | | | |
|---|---|---|---|---|
| 6,911,903 | B2 | 6/2005 | Gladstone et al. | 340/442 |
| 7,013,833 | B2 | 3/2006 | Lemberger et al. | 116/34 R |
| 7,030,743 | B2 | 4/2006 | Morris | 340/442 |
| 7,112,766 | B2 | 9/2006 | Lerner | 219/445.1 |
| 7,204,199 | B2 | 4/2007 | Ribi et al. | |
| 7,528,737 | B2 | 5/2009 | Hedtke | 340/870.01 |
| 7,641,358 | B1 | 1/2010 | Smith et al. | 362/183 |
| 2003/0214816 | A1* | 11/2003 | Barlian et al. | 362/555 |
| 2004/0146084 | A1 | 7/2004 | Hachtel et al. | 374/106 |
| 2005/0217558 | A1 | 10/2005 | Fitzer et al. | 116/203 |
| 2006/0220895 | A1 | 10/2006 | Arcaria et al. | 340/815.4 |
| 2007/0241916 | A1 | 10/2007 | Hedtke | 340/584 |
| 2009/0284381 | A1* | 11/2009 | Manahan | 340/590 |
| 2010/0039256 | A1 | 2/2010 | Manahan | 340/540 |
| 2010/0043695 | A1 | 2/2010 | Reichert | 116/207 |
| 2010/0163765 | A1* | 7/2010 | Gregoire | 251/62 |
| 2010/0229784 | A1 | 9/2010 | Bayne et al. | |
| 2010/0275676 | A1 | 11/2010 | King et al. | |

* cited by examiner

EXPLOSION INDICATOR FOR EXPLOSION-PROOF ENCLOSURES

RELATED APPLICATIONS

This application is related to U.S. patent application Ser. No. 11/960,904 entitled "Explosion Indicators for Use in Explosion-Proof Enclosures with Critical Equipment" filed on Dec. 20, 2007, in the name of Joseph Michael Manahan, and U.S. patent application Ser. No. 12/123,063 entitled "Explosion Indicator for Explosion-Proof Enclosures" filed on May 19, 2008, in the name of Joseph Michael Manahan. The complete disclosure of each of the above-identified related applications is hereby fully incorporated herein by reference.

TECHNICAL FIELD

The invention relates to indicator devices. More particularly, the invention relates to explosion indicator devices for use with explosion-proof enclosures.

BACKGROUND

Explosion-proof enclosures may be used to enclose critical equipment in a hazardous environment. Under some circumstances, enclosed equipment may be damaged when subjected to an explosion occurring internally within the enclosure, thus rendering the equipment faulty. Currently, devices or methods do not exist for alerting a user that an internal explosion has occurred in an enclosure housing equipment that is already equipped to withstand high pressures. As a result, in some instances, the equipment may continue to operate without maintenance under unsafe or faulty conditions, which may lead to further damage to the internal equipment, as well as to damage to any downstream equipment connected to the internal equipment.

Accordingly, a need exists in the art for providing an external indication of an explosion that occurs internally within an explosion-proof enclosure.

SUMMARY

The invention can satisfy the above-described need by providing an indicator device for providing indication of an explosion within an enclosure. A piston disposed within a portion of the indicator device that is inside the enclosure is displaced by the internal explosion. When displaced, contacts on the piston complete a circuit and power an indicator, such as a light or an alarm. The indicator indicates that an explosion has occurred within the enclosure.

According to one aspect, an explosion-proof indicator device includes a hollow sleeve coupled at a first end to a lens by a connector body. An indicator is positioned in the sleeve and disposed near the lens. The indicator can be a light source, such as a light-emitting diode (LED) or other suitable source of light. The light source is coupled to a power supply through a contact positioned in the sleeve. The contact is normally in the open, or disconnected, position such that power is not supplied to the light source. The indicator device also includes a housing coupled to a second end of the sleeve. A piston is positioned within the housing and disposed in an opposing relationship to the contact. When an explosion occurs in proximity to the piston, a pressure wave from the explosion acts on the piston to force the piston into the contact. The piston moves a portion of the contact to close the circuit between the power source and the light source to activate the light source. Light from the activated light source provides an indication of an explosion in proximity to the piston.

According to another aspect, the contact includes two contacts separated by a predetermined distance, and the piston includes a conductive member sized according to the predetermined distance. When a pressure wave from an explosion forces the piston into the contact, the conductive member on the piston connects the circuit path between the two contacts, thereby closing the circuit between the power source and the light source to activate the light source.

In yet another aspect, two additional contacts can be provided on an interior wall of the sleeve. The piston also can include contacts separated by a conductive member and disposed on the piston. The contacts on the piston can contact the contacts on the interior wall of the sleeve when the piston shifts in response to a pressure wave. Accordingly, the conductive member on the piston completes a circuit path between the two additional contacts. The contacts on the wall of the sleeve can be coupled to a shunt unit or a circuit breaker that is configured to activate when the circuit path is completed.

In certain aspects, the indicator device can include an audible alarm in communication with an external facility. The audible alarm can replace the light source. Alternatively, the audible alarm can be provided in addition to the light source. The audible alarm can be activated in a manner similar to activation of the light source.

According to yet another aspect of the invention, an explosion indicator system includes an indicator device coupled to an enclosure. The enclosure can contain critical equipment.

These and other aspects, objects, and features of the invention will become apparent from the following detailed description of exemplary embodiments, read in conjunction with, and reference to, the accompanying drawings.

BRIEF DESCRIPTION OF THE DRAWINGS

The invention may be better understood by reading the following description of non-limiting, exemplary embodiments with reference to the attached drawings, wherein like parts of each of the figures are identified by the same reference characters, and which are briefly described as follows.

The drawings illustrate only exemplary embodiments of the invention and are therefore not to be considered limiting of its scope, as the invention may admit to other equally effective embodiments.

DETAILED DESCRIPTION OF EXEMPLARY EMBODIMENTS

The application relates to indicator devices. More particularly, the application relates to explosion indicator devices for use with explosion-proof enclosures. The indicator devices are configured to detect an explosion internal to the enclosure and to provide an indication of the explosion on the outside of the enclosure. The indicator devices of the invention are of simple construction and assembled from easily replaceable parts, therefore possibly minimizing costs of servicing damaged or used devices.

Figure 1A:
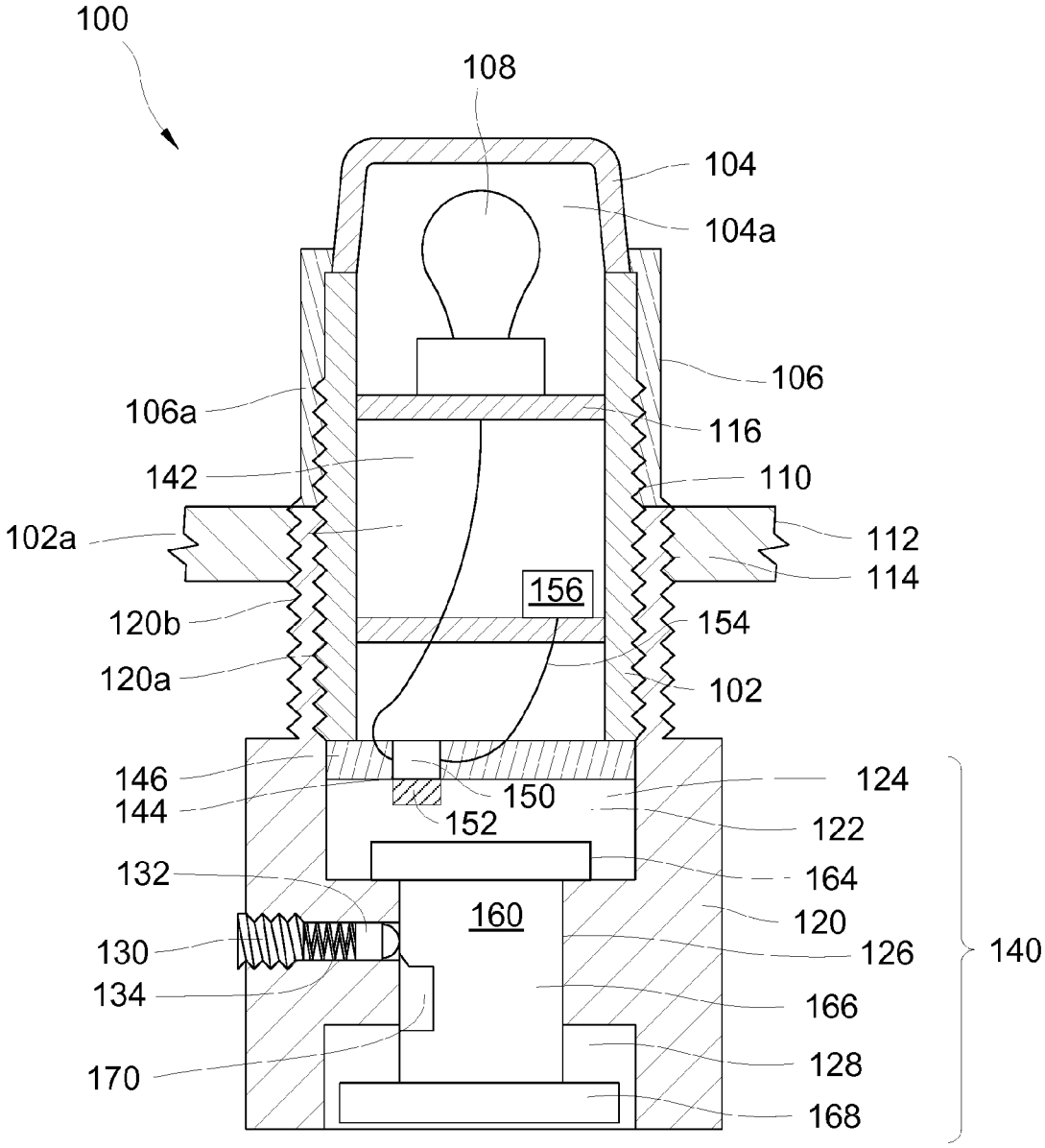
FIG. 1A is a side view of an explosion indicator device according to an exemplary embodiment of the invention.

Referring to FIG. 1A, an exemplary embodiment of an indicator device 100 comprises a sleeve 102, a glass jewel 104 having a cavity 104*a*, a connector body 106, and a local indicator 108. The sleeve 102 is coupled to the glass jewel 104 by the connector body 106. In certain embodiments, the sleeve 102 includes exterior threads 110 which threadably engage with interior threads 106*a* of the connector body 106.

The sleeve 102 is open at each end and includes a bore 102*a* therein. The cavity 104*a* of the glass jewel 104 and the bore 102*a* of the sleeve 102 are in communication so as to create a chamber within which the local indicator 108, such as an LED or other light source, is positioned. The local indicator 108 may be sealed within the bore 102*a* of the sleeve 102 with a sealing material 116. Suitable examples of sealing material 116 include, but are not limited to, epoxy fillers and CHICO™ sealing compound commercially available from Cooper Industries, Inc.

The sleeve 102 is coupled to a housing 120 at an end opposite the glass jewel 104. In certain embodiments, the threads 110 of the sleeve 102 threadably engage with interior threads 120*a* of the housing 120. Exterior threads 120*b* of the housing 120 threadably engage with interior threads 114 of an enclosure 112 having critical equipment (not shown). The housing 120 is positioned within the enclosure 112. The housing 120 includes an opening 122 extending therethrough and having a top region 124, a middle region 126, and a bottom region 128. The top region 124 and the bottom region 128 have a larger diameter than the middle region 126. The middle region 126 includes an opening 130 housing a catch pin 132 coupled to a spring 134.

The opening 122 of the housing 120 is in communication with the bore 102*a* of the sleeve 102 and houses an activation system 140 for activating the local indicator 108. The activation system 140 comprises a conductor 154 coupled at one end to a power source 156 positioned in the bore 102*a* of the sleeve 102. In certain alternative exemplary embodiments, the power source 156 may be exterior to the indicator device 100. In certain exemplary embodiments, the power source 156 is a battery. The conductor 154 is in communication at another end with a movable detent contact 144 positioned in the top region 124 of the housing 120 by a stationary plate 146. The stationary plate 146 is secured to the housing 120 by any means known to one having ordinary skill in the art. The movable detent contact 144 is also in communication with the local indicator 108 via a conductor 142. The movable detent contact 144 comprises a nonconductive portion 150 and a conductive portion 152. When the nonconductive portion 150 of the movable detent contact 144 is in contact with the conductors 154, 142, the circuit is open and power is not supplied to the local indicator 108. When the conductive portion 152 of the movable detent contact 144 is in contact with conductors 154, 142, the circuit is closed and power is supplied to the local indicator 108 and the local indicator 108 is activated or illuminated.

The activation system 140 also comprises a piston 160 positioned within the opening 122 of the housing 120 and spaced a distance below the detent contact 144. The piston 160 includes a top portion 164, a central portion 166, and a bottom portion 168. The top portion 164 and bottom portion 168 have a larger diameter than the central portion 166. The top portion 164 of the piston 160 is positioned in the top region 124 of the housing 120. The central portion 166 of the piston 160 is positioned in the middle region 126 of the housing 120. The bottom portion 168 of the piston 160 is positioned in the bottom region 128 of the housing 120. The central portion 166 of the piston 160 includes a recess or a groove 170 configured to receive the catch pin 132 upon activation of the activation system 140.

When there is little or no pressure in the enclosure 112, the activation system 140 is in an inactive state. In the inactive state, the piston 160 is disposed downward and the catch pin 132 contacts the central portion 166 of the piston 160 above the groove 170. In addition, the movable detent contact 144 is positioned such that the nonconductive portion 150 of the movable detent contact 144 is in contact with conductors 154, 142, and the circuit is open. Thus, power is not supplied to the local indicator 108 and the local indicator 108 is not illuminated or activated.

Figure 1B:
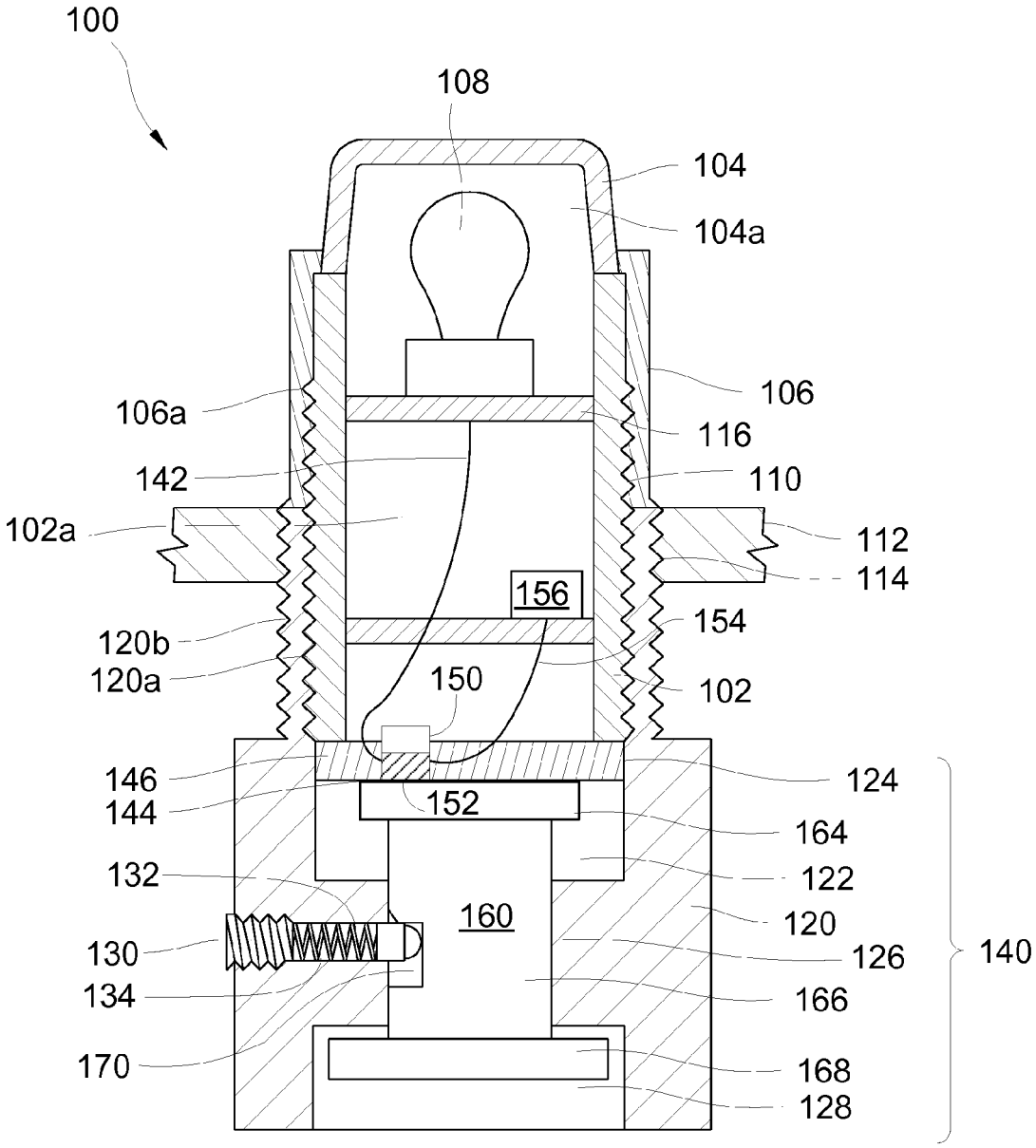
FIG. 1B is a side view of the exemplary explosion indicator device of FIG. 1A after being activated.

FIG. 1B illustrates the indicator device 100 after activation. Activation of the activation system 140 results from an increase in pressure within the enclosure 112, as in just prior to or during an explosion. When the interior of the enclosure 112 below the piston 160 experiences such an increase in pressure, the pressure forces the piston 160 to shift towards the movable detent contact 144. Air can be exhausted from the opening 122 through the connection between the threads 110 of the sleeve 102 and the interior threads 120*a* of the housing 120. The piston 160 pushes the detent contact 144 upwards such that the conductive portion 152 of the detent contact 144 contacts the conductors 142, 154. The piston 160 is then secured in place by the spring 134 forcing the catch pin 132 out of the opening 130 into the middle region middle region of the opening 122 to engage the groove 170 in the piston 160. When the conductive portion 152 of the movable detent contact 144 is in contact with conductors 142, 154, power from the power source 156 flows through the conductor 154, to the conductive portion 152 of the detent contact 144, through the conductor 142, and to the local indicator 108. As a result, the local indicator 108 is activated. For example, when the local indicator 108 is an LED light source, the LED light source is illuminated upon activation. To reset the indicator device 100 after activation, the catch pin 132 and the spring 134 can be accessed and removed through the opening 130 of the middle region 126 of the housing 120. Once the catch pin 132 is removed from the groove 170, the piston 160 can be shifted downward and the circuit opened.

Figure 2A:
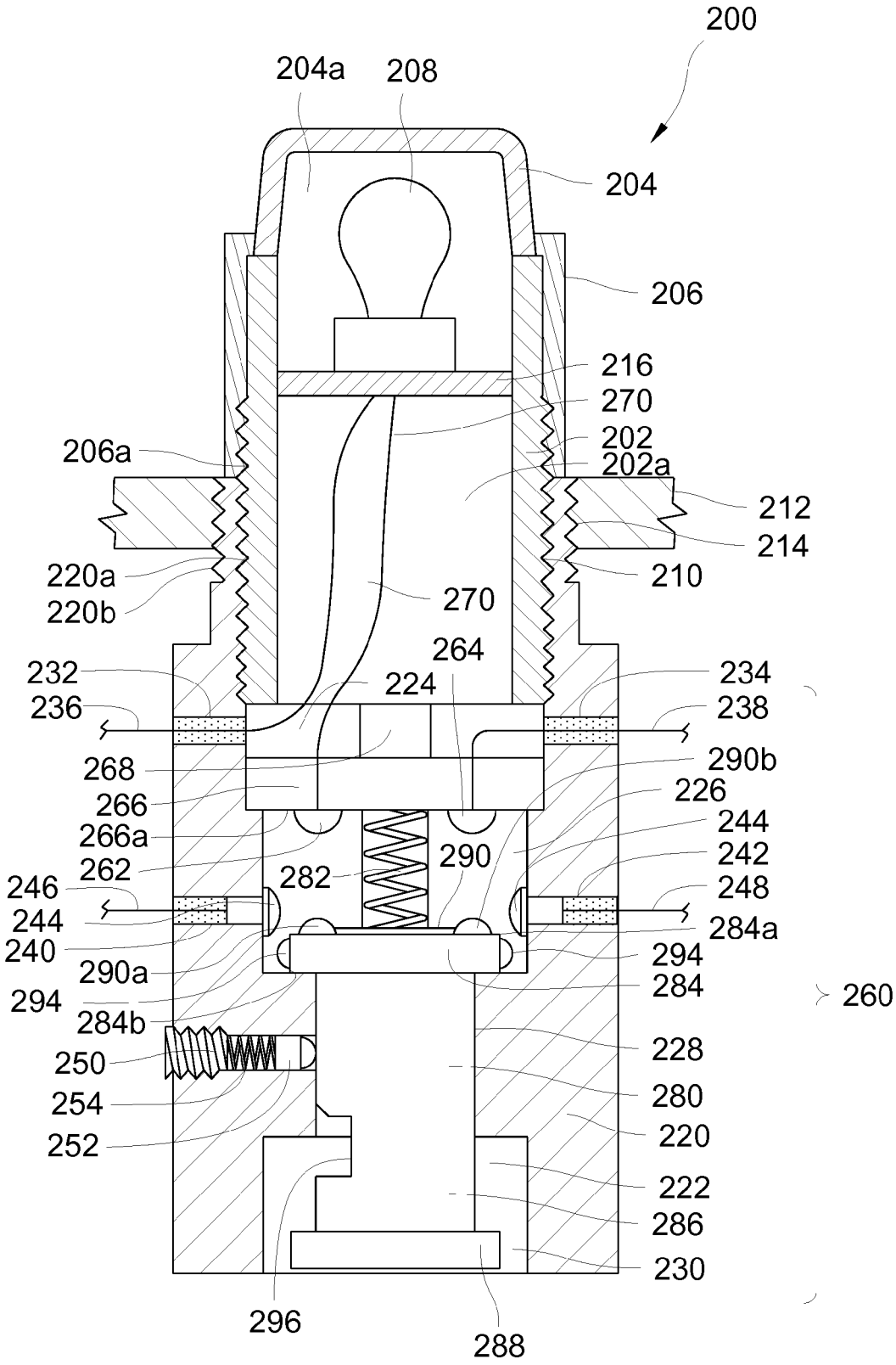
FIG. 2A is a side view of an explosion indicator device according to another exemplary embodiment of the invention.

FIG. 2A illustrates an indicator device 200 according to an alternative exemplary embodiment. The indicator device 200 comprises a sleeve 202, a glass jewel 204 having a cavity 204*a*, a connector body 206, and a local indicator 208. The sleeve 202 is coupled to the glass jewel 204 by the connector body 206. In certain embodiments, the sleeve 202 includes exterior threads 210 which threadably engage with interior threads 206*a* of the connector body 206.

The sleeve 202 is open at each end and includes a bore 202*a* therein. The cavity 204*a* of the glass jewel 204 and the bore 202*a* of the sleeve 202 are in communication so as to create a chamber within which the local indicator 208, such as an LED or other light source, is positioned. In certain embodiments, the local indicator 208 is sealed within the bore 202*a* of the sleeve 202 with a sealing material 216. Suitable examples of sealing material 216 include, but are not limited to, epoxy fillers and CHICO™ sealing compound commercially available from Cooper Industries, Inc.

The sleeve 202 is coupled to a housing 220 at an end opposite the glass jewel 204. In certain embodiments, the threads 210 of the sleeve 202 threadably engage with interior threads 220*a* in the housing 220. Exterior threads 220*b* of the housing 220 threadably engage with interior threads 214 of an enclosure 212 having critical equipment (not shown). The housing 220 is positioned within the enclosure 212. The housing 220 includes an opening 222 having a first region 224, a second region 226, a third region 228, and a fourth region 230. The first region 224 has a larger diameter than the second region 226. The second region 226 and the fourth region 230 have a larger diameter than the third region 228.

The housing 220 includes openings 232, 234 extending from the first region 224 to the exterior of the housing 220. A conductor 236 connects the local indicator 208 to neutral (not shown) via the opening 232. A conductor 238 connects an activation system 260 to an external power source (not shown) via the opening 234.

The housing 220 also includes openings 240, 242 extending from the second region 226 to the exterior of the housing 220. The openings 240, 242 include shunt trip contacts 244 that are connected to a power to shunt (not shown) via a conductor 246 and a shunt coil and/or a secondary pressure sensor (not shown) via a conductor 248. Once an explosion is indicated and the shunt trip contacts 244 trip a circuit breaker (not shown), power supplied to equipment within the enclosure 212 is terminated to prevent further damage to the equipment. In certain embodiments, several pieces of equipment (not shown) may be wired in series for protection with a single circuit breaker. Once tripped, the circuit breaker remains tripped until mechanically reset.

In certain embodiments, the conductors 236, 238, 246, 248 are sealed within the openings 232, 234, 240, 242, respectively, with a sealing compound so as to contain an explosion. Suitable examples of the sealing compound include, but are not limited to, epoxies and cement compounds.

The housing further includes an opening 250 extending from the third region 228 to the exterior of the housing 220. The opening 250 houses a catch pin 252 coupled to a spring 254.

The opening 222 of the housing 220 is in communication with the bore 202*a* of the sleeve 202 and houses activation system 260 for activating the local indicator 208. The activation system 260 comprises bulb contacts 262, 264 positioned on a lower side 266*a* of a stationary platform 266 in the first region 224 of the housing 220. The stationary platform 266 may be sealed in place or fixed in place by a connecting rod 268 sealed within the bore 202*a* of the sleeve 202. The connecting rod 268 can be sealed in place similar to the way the local indicator 208 is sealed within the sleeve 202 with the sealing material 216. The bulb contact 262 is electrically coupled to the local indicator 208 via a conductor 270. The bulb contact 264 is coupled to the external power source via the conductor 238. In certain alternative embodiments, the power source is a battery positioned within the sleeve 202.

The activation system 260 also comprises a piston 280 positioned within the opening 222 of housing 220. Prior to activation of the activation system 260, the piston 280 is spaced a distance below the bulb contacts 262, 264. In certain embodiments, a resistance spring 282 biases the piston 280 away from the bulb contacts 262, 264, and prevents the piston 280 from contacting the bulb contacts 262, 264.

The piston 280 includes a top portion 284, central portion 286, and bottom portion 288. The top portion 284 and bottom portion 288 have a larger diameter than the central portion 286. The top portion 284 of the piston 280 is positioned in the second region 226 of the housing 220. The bottom portion 288 of the piston 280 is positioned in the fourth region 230 of the housing 220.

The top portion 284 of the piston 280 comprises a conductive contact plate 290 having contacts 290*a*, 290*b* on a top surface 284*a* of the top portion 284 of the piston 280. The top portion 284 also comprises contacts 294 positioned on the sides 284*b* of the top portion 284. The thickness of contacts 294 may be varied based on the spring 282 resistance and length of time needed to activate the shunt trip contacts 244. The central portion 286 includes a groove 296 configured to receive the catch pin 252 upon activation of the activation system 260.

Figure 2B:
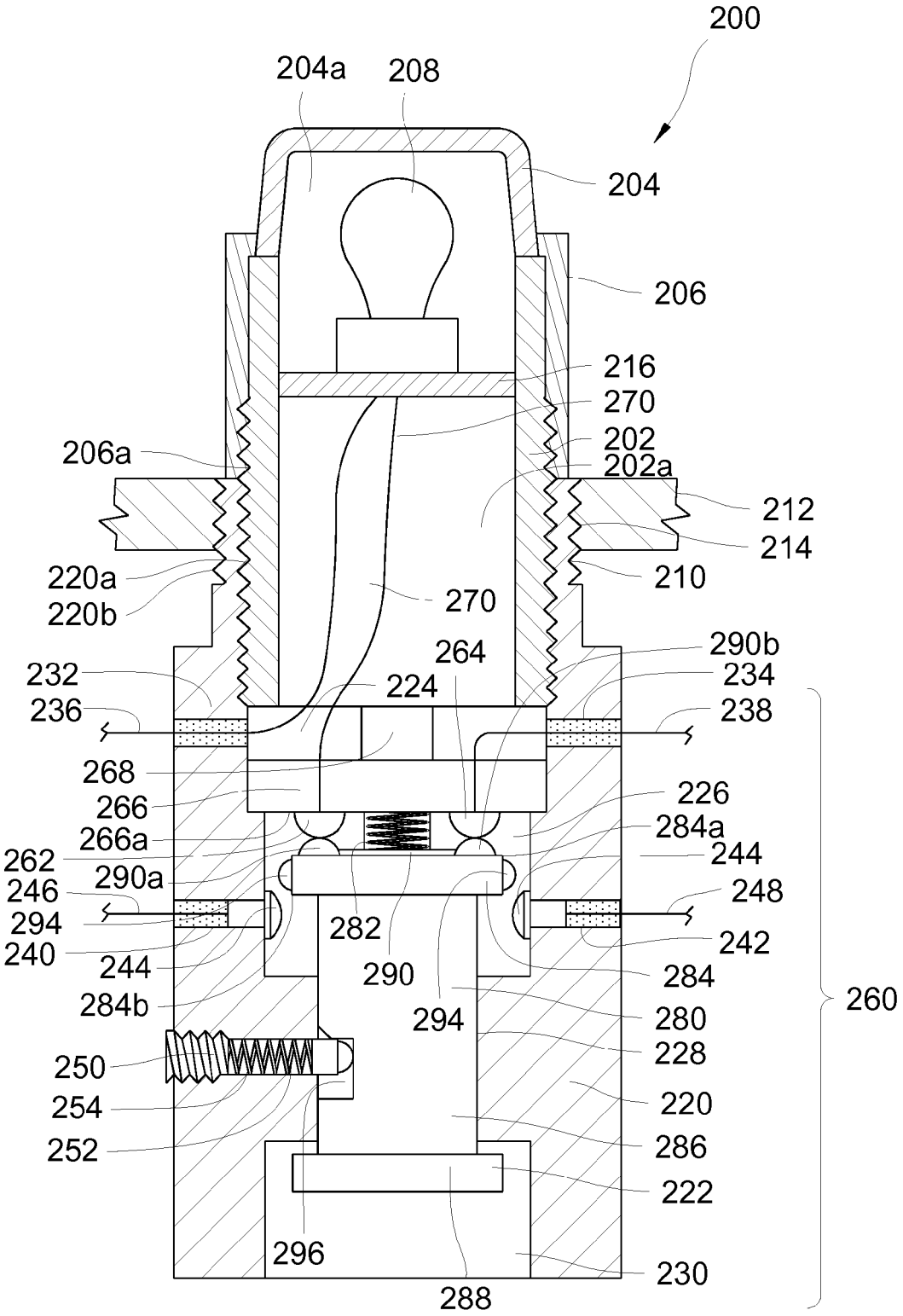
FIG. 2B is a side view of the exemplary explosion indicator device of FIG. 2A after being activated.

FIG. 2B illustrates the indicator device 200 after activation. Activation of the activation system 260 results from an increase in pressure within the enclosure 212, as in prior to or during an explosion. When the enclosure 212 experiences a pressure great enough to overcome the resistance of the spring 282, the piston 280 shifts upward and contacts 290*a*, 290*b* contact the bulb contacts 262, 264. The bulb contact 264 is electrically connected to a power source. When the contacts 290*a*, 290*b* and the bulb contacts 262, 264 come in contact with each other, a circuit is completed from the power source through the contacts to the indicator 208, thereby energizing and activating the indicator 208. For instance, when the local indicator 208 is an LED light source, the LED light source is illuminated upon activation. Additionally, as the contacts 294 shift pass the shunt trip contacts 244 and trip the circuit breaker (not shown), power supplied to equipment within the enclosure 212 is terminated to prevent further damage to the equipment. The piston 280 is secured in place by the spring 254 forcing the catch pin 252 out of the opening 250 to engage the groove 296 in the piston 280. To reset the indicator device 200 after activation, the catch pin 252 can be accessed and relieved through the opening 250 of the third region 228 of the housing 220.

Figure 3:
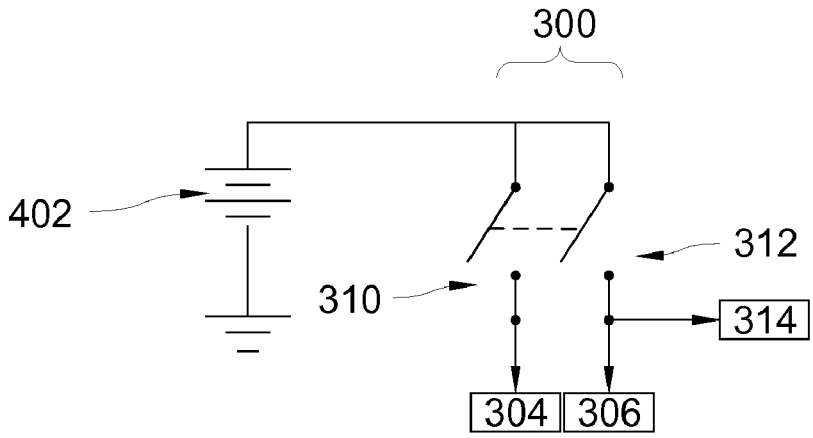
FIG. 3 is a circuit diagram of an explosion indicator device according to an exemplary embodiment of the invention.

FIG. 3 is a circuit diagram for a single indicator device 300 according to an exemplary embodiment. A power source, such as a battery 302, is electrically coupled to the indicator device 300 having a breaker shunt 304 and an indicator, such as an LED 306. The breaker shunt 304 and the LED 306 are configured in parallel. Prior to activation of the indicator device 300, switches 310 and 312 are in an open, or disconnected, state. After activation, switch 310 closes and allows power from the battery 302 to be supplied to the breaker shunt 304 to signal the termination of power to electrical equipment in an enclosure (not shown). Also after activation of the indicator device 300, the switch 312 closes and allows power from the battery 302 to be supplied to the LED 306 and the LED 306 is illuminated for local indication that an explosion has occurred.

In certain embodiments, the indicator device 300 may also communicate wirelessly to an external monitoring station 314 that an explosion has occurred. In certain alternative embodiments, the indicator device 300 may communicate an audible or visual alarm signal and/or a text message displayed locally or communicated to the monitoring station 314. In some embodiments, the indicator device 300 may be wired into a facilities emergency system or a fire alarm.

Figure 4:
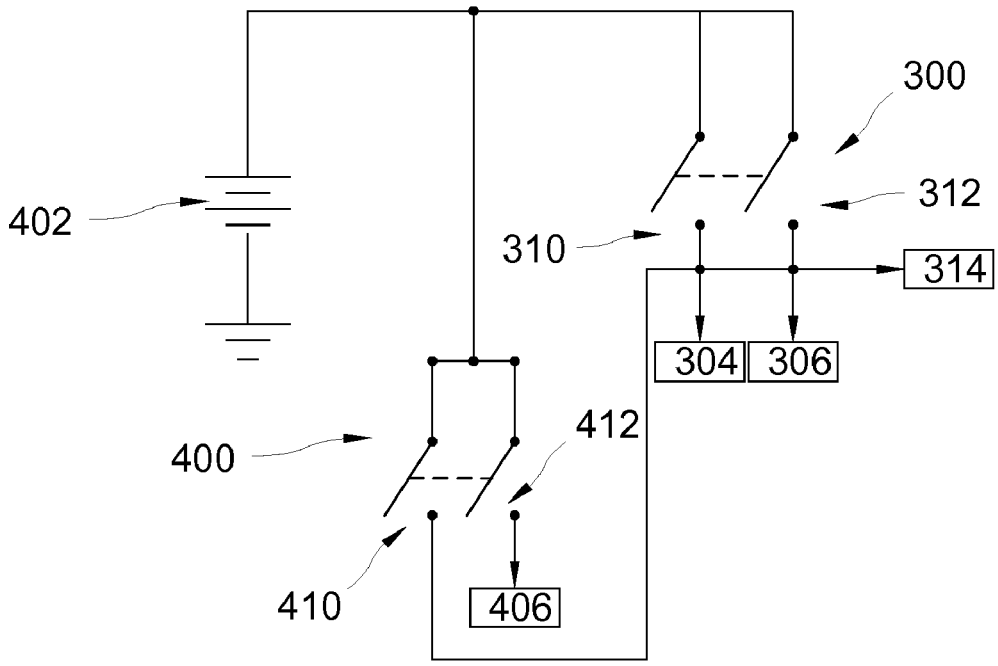
FIG. 4 is a circuit diagram of a series of explosion indicator devices, including the exemplary indicator device of FIG. 3, according to an exemplary embodiment of the invention.

FIG. 4 is a circuit diagram illustrating a series of indicator devices according to an exemplary embodiment. A power source, such as a battery 402, is electrically coupled to the indicator device 300 and an indicator device 400. The indicator devices 300, 400 are connected in parallel. In certain alternative embodiments, additional indicator devices may be connected in parallel. The indicator device 400 is electrically coupled to the indicator device 300 and an indicator, such as an LED 406. Prior to activation of the indicator device 400, switches 410 and 412 are in an open, or disconnected, state. After activation, the switch 410 closes and sends a signal to the breaker shunt 304 to terminate the supply of power to electrical equipment in an enclosure (not shown). Also after activation of the indicator device 400, the switch 412 closes and allows power from the battery 402 to be supplied to the LED 406 and the LED 406 is illuminated for local indication that an explosion has occurred. Similarly, the switch 312 closes and power from the battery 402 is supplied to the LED 306 and the LED 306 is illuminated for local indication that an explosion has occurred.

In certain embodiments, the indicator device 300 may also communicate wirelessly to an external monitoring station 314 that an explosion has occurred. In certain alternative embodiments, the indicator device 300 may communicate an audible or visual alarm signal and/or a text message displayed locally or communicated to the monitoring station 314. In some embodiments, the indicator device 300 may be wired into a facilities emergency system or a fire alarm.

Generally, the indicator devices of the invention include a sleeve open at a first end and a second end and having a bore therein, a dome-like transparent member such as glass jewel having a cavity, a connector body, contact(s) for completing a circuit, a slidable piston in communication with the contact (s), and an indicator. The materials of construction for the indicator devices of the invention depend on a variety of factors, such as the operating temperature and pressure, the particular application, equipment conditions, and the like, which will be recognizable by a person having ordinary skill in the art.

The sleeve 102, 202 of the indicator devices of the invention may be made of any material that can withstand the presence of flammable vapors, gases, or highly combustible dusts. Suitable examples of the sleeve 102, 202 materials include, but are not limited to, brass, stainless steel, aluminum, or plastics appropriate for hazardous applications. The sleeve 102, 202 construction should provide integrity to the indicator device 100, 200. For example, the threads 110, 210 may be included in the sleeve 102, 202 to provide a flame-resistant exit path in the case of an explosion.

Suitable examples of the dome-like transparent member include, but are not limited to, glass jewel 104, 204, transparent plastic materials, or other means of visualizing an indicator. In some embodiments, the dome-like transparent member may be clear. In some embodiments, the dome-like transparent member may be colored so as to enhance visually any light emitted by the indicator within.

The connector body 106, 206 of the indicator devices of the invention may be made of any material that can withstand the presence of flammable vapors, gases, or highly combustible dusts. Suitable examples of the connector body 106, 206 materials include, but are not limited to, those suitable for environmental exposure. The connector body 106, 206 is a mechanical means to connect the transparent member to the sleeve 102, 202. The connector body 106, 206 also may provide an explosion-proof joint between the transparent member and the connector body 106, 206 via a flat flamepath, and/or an explosion-proof joint within the body via a threaded flamepath. Furthermore, the connector body 106, 206 may be a guard unit for protecting the dome-like transparent member to achieve higher impact standards.

The housing 120, 220 of the indicator devices of the invention may be made of any material that can withstand the presence of flammable vapors, gases, or highly combustible dusts. Suitable examples of the housing 120, 220 materials include, but are not limited to, brass, stainless steel, aluminum, or plastics appropriate for hazardous applications. The housing 120, 220 construction should provide integrity to the indicator device 100, 200. For example, the threads 120*b*, 220*b* may be included in the housing 120, 220 to provide a flame-resistant exit path in the case of an explosion.

In certain embodiments, the stationary plate 146, the stationary platform 266 is fabricated from an insulating material. Suitable examples of insulating materials include, but are not limited to, glass-reinforced nylon and glass-reinforced polyester.

Generally, systems of the invention comprise the indicator devices 100, 200 of the invention coupled to the enclosure 112, 212. The indicator devices 100, 200 of the invention may have features that allow it to be easily coupled to the enclosures 112, 212 comprising equipment. For example, the sleeves 102, 202 may include outer threads 110, 210 adapted for threading engagement with complimentary threads 120*b*, 220*b* formed in the interior wall of the housing 120, 220 already coupled to the enclosure 112, 212. In alternative embodiments, the sleeves 102, 202 may include outer threads 110, 210 adapted for threading engagement with complimentary threads 114, 214 formed in the interior wall of the enclosures 112, 212. In another example, the indicator devices 100, 200 may include a highly machined flat surface (not shown) that may be bolted or secured to a highly machined flat surface of the enclosures 112, 212. Alternatively, the threaded sleeves 102, 202 of the indicator devices 100, 200 may be coupled to the enclosures 112, 212 via a nut (not shown) or threads on the plate located within the enclosures 112, 212.

Generally, methods of providing a system for detecting a high stress event, comprise providing the indicator devices 100, 200 of the invention coupled to the explosion-proof enclosures 112, 212, wherein upon exposure to a pressure differential causes the activation systems 140, 260 to respond to allow the activation of the indicators 108, 208.

Any spatial references herein such as, for example, "upper," "lower," "above," "below," "rear," "between," "beneath," etc., are for the purpose of illustration only and do not limit the specific orientation or location of the described structure.

Therefore, the invention is well adapted to attain the ends and advantages mentioned as well as those that are inherent therein. The particular embodiments disclosed above are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit of this invention as defined by the appended claims. For instance, the indicator devices may further include a gasket, seal, or other sealing device positioned between the sleeve and the transparent member. Also, the sleeve may be directly threaded to the interior threads of the enclosure having critical equipment. In addition, a neoprene baffle may be positioned at the base of the piston to maintain a seal between the indicator device and its exterior. Furthermore, the bore of the sleeve in communication with the opening within the housing may be referred to as a bore. Additionally, the indicator device may include a sealing material for sealing the local indicator within the bore of the sleeve. Also, the housing may be constructed of any material that maintains a seal between the piston and the housing so as to prevent the piston from shifting upwards and downwards repeatedly. In addition, the spring biasing the piston from completing the circuit may be replaced by an alternative biasing element. Furthermore, no limitations are intended to the details of construction or design herein shown, other than as described in the claims below. It is therefore evident that the particular illustrative embodiments disclosed herein may be altered or modified and all such variations are considered within the scope and spirit of the claimed invention. The terms in the claims have their plain, ordinary meaning unless otherwise explicitly and clearly defined by the patentee.

What is claimed is:

1. An indicator device, comprising:

a sleeve having a first end, a second end, and a bore formed therein;

a transparent member coupled to the first end of the sleeve;

at least one contact disposed in the bore of the sleeve;

an indicator in communication with the at least one contact; and a movable piston positioned in a first position that is spaced apart from the at least one contact, wherein the movable piston is moveable from the first position to a second position that is in contact with the at least one contact to thereby complete a circuit to the indicator to activate the indicator, wherein the piston shifts from the first position to the second position in response to an increase in pressure, and wherein the piston shifts in a direction towards the first end of the sleeve in response to the increase in pressure.

2. The indicator device of claim 1, wherein the transparent member is coupled to the first end of the sleeve by a connector body.

3. The indicator device of claim 1, further comprising a housing coupled to the second end of the sleeve, wherein the movable piston is positioned in the housing.

4. The indicator device of claim 1, further comprising a stationary plate disposed in the bore of the sleeve, wherein the at least one contact is a movable contact coupled to the plate and in communication with the piston.

5. The indicator device of claim 1, wherein the at least one contact comprises a first contact electrically coupled to the indicator, a second contact separate from the first contact and electrically coupled to a power source, and a third contact coupled to the piston, wherein when the movable piston moves into the second position, the third contact is in contact with the first and second contacts to thereby complete the circuit to activate the indicator.

6. The indicator device of claim 1, further comprising a pin disposed in the sleeve, wherein the piston comprises a notch adapted to receive the pin when the piston moves to the second position.

7. The indicator device of claim 1, further comprising a spring positioned between the at least one contact and the piston, the spring biasing the piston away from the at least one contact.

8. The indicator device of claim 1, further comprising a shunt unit coupled to a circuit breaker and shunt contacts coupled to the piston, wherein when the movable piston moves into the second position, the shunt contacts contact the shunt unit to thereby trip the circuit breaker.

9. The indicator device of claim 1, further comprising a baffle positioned at a base of the piston.

10. The indicator device of claim 1, wherein the increase in pressure is from a pressure wave created by an explosion.

11. The indicator device of claim 1, wherein the transparent member comprises a cavity that is in communication with the bore to thereby create a chamber, and wherein the indicator is a light source disposed within the chamber.

12. The indicator device of claim 1, wherein the indicator comprises an alarm in communication with an external facility.

13. An indicator system, comprising:

an enclosure; and an indicator device coupled to the enclosure, wherein the indicator device comprises:

a sleeve having a first end, a second end, and a bore formed therein;

a transparent member coupled to the first end of the sleeve;

a housing coupled to the second end of the sleeve, the housing comprising a movable contact coupled to a stationary plate within the bore, an indicator in communication with the movable contact, and a movable piston within the bore positioned in a first position that is spaced apart from the movable contact, wherein upon an increase in pressure within the enclosure, the movable piston shifts from the first position to a second position that is in contact with the movable contact to thereby complete a circuit to the indicator to activate the indicator, and wherein the piston shifts in a direction towards the first end of the sleeve in response to the increase of the pressure.

14. The indicator system of claim 13, wherein the transparent member is coupled to the first end of the sleeve by a connector body.

15. The indicator system of claim 13, wherein the movable contact comprises a nonconductive portion and a conductive portion.

16. The indicator system of claim 13, wherein the movable contact comprises a nonconductive portion and a conductive portion, wherein upon the increase in pressure within the enclosure, the piston forces the movable contact to shift the conductive portion so as to electrically couple the indicator.

17. The indicator system of claim 13, further comprising a pin disposed in the housing, wherein the piston comprises a notch adapted to receive the pin when the piston moves to the second position.

18. The indicator device of claim 13, further comprising a baffle positioned at a base of the piston.

19. An indicator system, comprising:

an enclosure; and an indicator device coupled to the enclosure, wherein the indicator device comprises:

a sleeve having a first end, a second end, and a bore formed therein;

a transparent member coupled to the first end of the sleeve;

a housing coupled to the second end of the sleeve, the housing comprising a first contact and a second contact coupled to a stationary plate within the bore, wherein the first contact is in communication with a power source, an indicator in communication with the second contact, and a piston positioned within the bore and having a contact plate, the piston positioned in a first position that is spaced apart from the first and second contacts, wherein the piston is moveable from the first position to a second position that is in contact with the first and second contacts to thereby complete a circuit to the indicator to activate the indicator, and wherein the piston shifts from the first position to the second position in response to an increase in pressure within the enclosure.

20. The indicator device of claim 19, further comprising a pin disposed in the housing, wherein the piston comprises a notch adapted to receive the pin when the piston moves to the second position.

21. The indicator device of claim 19, further comprising a spring positioned between the first and second contacts and the contact plate, the spring biasing the piston away from first and second contacts.

22. The indicator device of claim 19, further comprising a shunt unit coupled to a circuit breaker and shunt contacts coupled to the piston, wherein when the piston moves into the second position, the shunt contacts contact the shunt unit to thereby trip the circuit breaker.

23. The indicator device of claim 19, further comprising a baffle positioned at a base of the piston.

24. An indicator device, comprising:

a sleeve having a first end, a second end, and a bore formed therein;

a transparent member coupled to the first end of the sleeve;

at least one contact disposed in the bore of the sleeve;

an indicator in communication with the at least one contact;

a movable piston positioned in a first position that is spaced apart from the at least one contact, wherein the piston is moveable from the first position to a second position that is in contact with the at least one contact to thereby complete a circuit to the indicator to activate the indicator; and a pin disposed in the sleeve, wherein the piston comprises a notch adapted to receive the pin when the piston moves to the second position.

* * * * *